United States Patent [19]

Schimweg et al.

[11] Patent Number: 5,022,196

[45] Date of Patent: Jun. 11, 1991

[54] EXPANDABLE HONING TOOL

[75] Inventors: John J. Schimweg, St. Charles; Robert M. Sunnen, Frontenac; Rickey K. Wilken, St. Clair, all of Mo.

[73] Assignee: Sunnen Products Company, St. Louis, Mo.

[21] Appl. No.: 102,658

[22] Filed: Sep. 30, 1987

[51] Int. Cl.[5] ..... B24B 9/02

[52] U.S. Cl. ..... 51/338; 51/339; 51/340; 51/346

[58] Field of Search ..... 51/338, 330, 331, 339, 51/340, 342, 343, 344, 346, 72 R, DIG. 6; 408/239 R

[56] References Cited

U.S. PATENT DOCUMENTS

| | | | |
|---|---|---|---|
| 1,773,177 | 8/1930 | Groetchen | 51/DIG. 6 |
| 3,526,057 | 9/1970 | Hackman, Jr. | 51/72 R |
| 3,984,192 | 10/1976 | Wanner et al. | 408/239 R |

*Primary Examiner*—M. Rachuba

*Attorney, Agent, or Firm*—Haverstock, Garrett & Roberts

[57] ABSTRACT

A honing tool or mandrel mountable for rotation on a honing machine comprising an elongated substantially tubular member having inner and outer surfaces, the inner surface being conically tapered over substantially the length thereof, the outer surface including a portion having abrasive particles thereon, an elongated expander member positioned extending through the tubular member and having an outer surface tapered for making surface-to-surface contact with the tapered inner surface of the tubular member, the expander member being axially movable within the tubular member to change the diameter thereof uniformly along its length, the tubular member being attachable to a honing machine for rotation therewith adjacent one end portion thereof by a mounting structure which enables the tubular member to expand and contract thereat to increase or decrease the diameter thereof. The abrasive particles attached to the tubular member form work engaging mandrel portions along at least a portion of the outer surface thereof, all of the work engaging portions being located on a substantially cylindrical honing envelope. The present mandrel constructions are especially adaptable for use in multi-stroke honing applications and also lend themselves to a two-piece construction including a tubular honing portion and a drive assembly portion.

23 Claims, 4 Drawing Sheets

EXPANDABLE HONING TOOL

The present invention relates to an expandable honing tool or mandrel which is adjustable within limits during a honing operation and, more particularly, to several embodiments of a honing mandrel each of which includes an elongated tubular honing member having an opening extending therethrough adaptable for cooperatively receiving an elongated expander member or wedge assembly, the expander member or wedge assembly being axially movable within the tubular honing member to expand such member uniformly over its entire length to increase or decrease the diameter thereof. The present honing tool constructions are particularly adaptable for use in multi-stroke honing applications wherein increases and decreases in the honing tool diameter can be accomplished during a honing operation. Use of the present honing tools produces more uniform and more accurately honed work surfaces with a much greater range of honing diameter adjustability during a honing operation.

BACKGROUND OF THE INVENTION

Many different types of honing mandrels and other honing devices have been designed and manufactured in the past for a wide variety of uses and applications. There also exists numerous designs and constructions of honing mandrels having abrasive assemblies mounted thereon which are adjustable during a honing operation, some of these mandrels utilize single radially adjustable abrasive assemblies while others utilize a plurality of circumferentially spaced abrasive assemblies, one or more of which are radially adjustable during a honing operation to maintain the abrasive assemblies in contact under pressure with a work surface being honed. Typical of the known adjustable honing mandrels and the known abrasive assembly movement means are the constructions shown and disclosed in Sunnen U.S. Pat. Nos. Re 18,763; 1,902,194; 1,904,336; 1,946,041; 1,982,836; 2,040,281; 2,815,615 and 3,378,962.

It has also been common practice in the past to construct honing mandrels having body portions with a central pinion gear rotatably mounted therein, and wherein a plurality of work engaging assemblies are mounted for radial movement on the mandrel body. These mandrel constructions include rack gear portions or pin members which cooperatively engage pinion gears or radial pins and work engaging portions which engage the work surface to be honed. In such prior art constructions, all of the work engaging assemblies are moved radially outwardly at the same rate. Typical of such constructions are the constructions shown and disclosed in Sunnen U.S. Pat. Nos. 3,378,962 and 4,524,549. None of the known prior art honing mandrel constructions which are adjustable during a honing operation utilize an expander member or wedge assembly which moves within a tubular member to uniformly increase the diameter of the tool over its entire length.

Honing tool constructions which utilize an expander member or wedge assembly for increasing the diameter of the mandrel are typically associated with single pass through honing mandrels. With known single pass through devices, it has not been possible to change the honing diameter of such devices during a honing operation but only to preset the honing diameter prior to the honing operation to establish the desired stock removal. For this reason, known single pass through mandrels, and especially those that use super abrasive materials such as abrasives that include diamond particles, particles of cubic boron nitride and other like hard materials, have been tapered over most of their length to control the amount of material that can be removed from the workpiece to establish a desired diameter and work surface smoothness. No adjustment of the honing diameter is possible during honing when using known single pass through honing devices, and this has greatly limited their usefulness and has substantially reduced the amount of stock that can be removed from a work surface. Typical of such known single pass through honing tool constructions are the constructions shown and disclosed in Althen U.S. Pat. Nos. 4,197,680 and 4,253,279.

The present honing mandrel constructions, unlike the known single pass through honing devices, are specifically designed for multi-stroke honing applications and each includes a honing surface which is substantially cylindrical, preferably not tapered, along its length. Also, importantly, each of the present mandrel constructions, unlike the known in-process adjustable mandrel constructions, provide for relative axial movement between a tubular honing member and an expander member or wedge assembly during a honing operation so as to uniformly change the honing diameter of such tool along its length. This enables a user to achieve a more uniform and more accurately honed work surface with a much greater range of honing diameter adjustability as compared to the known prior art constructions and especially single pass devices. These features in a honing tool represent an important advancement in the honing art as will be hereinafter explained.

SUMMARY OF THE INVENTION

The present invention teaches the construction and operation of several embodiments of a honing tool or mandrel mountable for rotation on a honing machine, each of the present tool constructions including an elongated substantially tubular member having an opening or passageway extending the entire length therethrough adaptable for insertably receiving an elongated expander member or wedge assembly positioned for axial movement therewithin. The tubular honing member includes inner and outer surfaces, the inner surface being conically tapered over substantially its entire length, while the outer honing surface is preferably cylindrical or substantially cylindrical along its entire length and includes abrasive particles attached to at least a portion thereof. In contrast, the expander member or wedge assembly includes an outer surface which is similarly conically tapered over the length thereof at the same taper rate as the conical taper associated with the inner surface of the tubular member into which it is positioned. This means that when the expander member is positioned within the tubular member, the outer surface of the expander member is in surface-to-surface contact with the inner surface of the tubular honing member. This is important to the present tool constructions because it is this specific constructional arrangement between the expander member and the tubular honing member which enables the diameter of the tubular member to be expanded uniformly over its entire length as the expander member is axially moved therein. In this regard, one end portion of the expander member is attached to means associated with the honing machine which is operable to produce relative axial movement between the expander member and the tubular honing member to change the diameter of the outer surface of such member. The tubular honing member also includes a narrow slot or groove extending along its entire length on one side thereof to enable such member to expand and contract as the expander member is advanced or retracted axially therein.

During a honing operation, the present honing tools are rotatable about an axis of rotation and each includes means adjacent one end portion of the tubular member for mounting the tool or mandrel to a rotatable member on the honing machine for rotation therewith. Since the tubular member rotates during a honing operation while the expander member or wedge assembly is axially moved therein, it is important that relative rotational movement between the tubular member and the expander member or wedge assembly be prevented. Several alternative means utilizing various key and slot arrangements for preventing such relative rotational movement between the tubular member and the wedge assembly are also disclosed herein.

One of the important advantages of the present tool constructions over prior art constructions is that the present constructions include an expander member or wedge assembly which moves within the tubular honing member to radially enlarge and expand or retract and reduce the honing tool diameter. This is done during a honing operation as stock is being removed from the workpiece in order to maintain the abrasive portion of the tool engaged with the workpiece under pressure until the desired final diameter of the workpiece has been achieved. Another important advantage is that the work engaging honing surface or surfaces of each of the present mandrels are cylindrical or substantially cylindrical along the tool's length. This enables the outer honing surface or surfaces of each mandrel to expand uniformly along its length during a honing operation thereby producing more uniform and more accurately honed work surfaces. This is true because both the abrasive portion of the present tools as well as the non-abrasive or holder portion of such tools expand uniformly over their entire length. This results in more uniform and more accurately honed work surfaces since the entire abrasive portion of the tool is maintained in operative engagement with the work surfaces during honing. This is not true of the known prior art mandrel constructions which utilize a wedge assembly such as single pass through honing mandrels wherein the outer surface of such mandrels are preferably tapered over a portion of their length and therefore only a portion of the abrasive portion of such tools is maintained in operative engagement with the work surface. Furthermore, by being able to expand the honing diameter, albeit over relatively narrow ranges in the order of up to about .050 inches, it is possible, when using the present honing tools, to achieve a much larger range of honing diameters with a single tool than presently is available with single pass through honing mandrels, and therefore one mandrel or tool can be used to remove much more stock in a continuous operation and is also able to hone a much wider range of surface diameters than has been possible in the past using super abrasives on single pass through honing mandrels.

The present tool constructions are also especially adaptable for use in multi-stroke honing applications which are able to accomplish the same high degree of honing accuracies that are achieved by single pass through honing mandrels while at the same time providing a relatively wider range of honing diameters per tool, and stock removals than are not available from single pass through honing mandrels. All of the features and capabilities afforded by the present tool devices represent important advancements in the honing art.

It is therefore a principal object of the present invention to teach the construction and operation of an in-process expandable and retractable honing tool for more accurately and more uniformly finishing and sizing work surfaces.

Another object is to provide a tubular honing tool which is adjustable within limits during a honing operation.

Another object is to provide an expandable honing tool using super abrasives which tool has a much greater range of honing diameter adjustability during a honing operation than known single pass through mandrels using super abrasives.

Another object is to teach the construction and operation of a honing tool wherein such tool is uniformly expandable and contractable over its entire length to change the honing diameter thereof.

Another object is to teach the construction and operation of an expandable tubular honing tool which utilizes an elongated expander member or wedge assembly axially movable therein during honing to expand the honing portion of such tool uniformly over its entire length.

Another object is to provide an expandable honing tool that uses super abrasives and which is particularly adaptable for use in honing mandrels that are stroked.

Another object is to provide a honing tool wherein the tubular honing member includes an abrasive outer surface wherein the work engaging portions are all located on a substantially cylindrical honing envelope and wherein the member has an inner surface which is axially tapered for cooperating with the similarly tapered outer surface of the elongated expander member or wedge assembly.

Another object is to teach the construction and operation of a honing tool which is relatively easy to assemble and mount to an existing honing machine.

Another object is to teach several alternative means for preventing relative rotational movement between a tubular honing member and the expander member or wedge assembly positioned therewithin.

Another object is to teach the construction of a tubular honing mandrel rotatable by means engageable adjacent one end thereof, which mandrel can be expanded and contracted during a honing operation by means movable axially therein.

Another object is to uniformly change the honing diameter of a tubular mandrel during a honing operation.

Another object is to teach means for mounting a tubular honing member for rotation on a honing machine in such a way that the honing member can expand and contract at the location where it is mounted on the machine.

Another object is to teach novel means for imparting axial stroking force to a rotating tubular mandrel.

These and other objects and advantages of the present invention will become apparent to those skilled in the art after considering the following detailed specification in conjunction with the accompanying drawings.

DETAILED DESCRIPTION OF THE INVENTION

Figure 1:
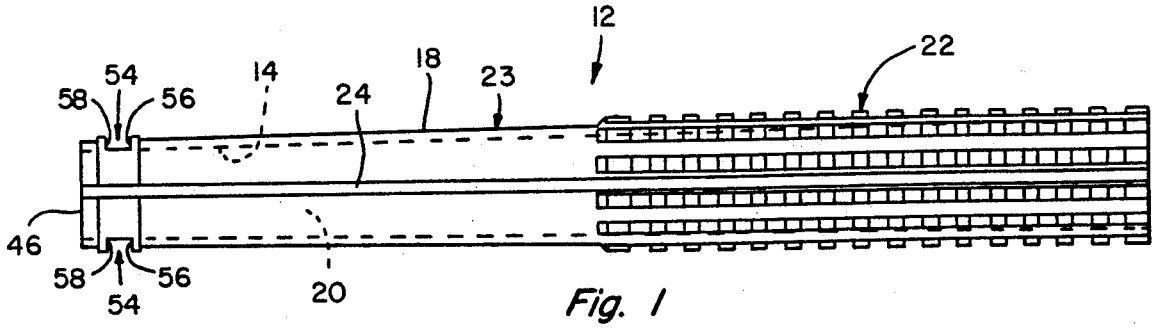
FIG. 1 is a side elevational view of the tubular honing member associated with one embodiment of a honing tool constructed to the teachings of the present invention.
Figure 2:
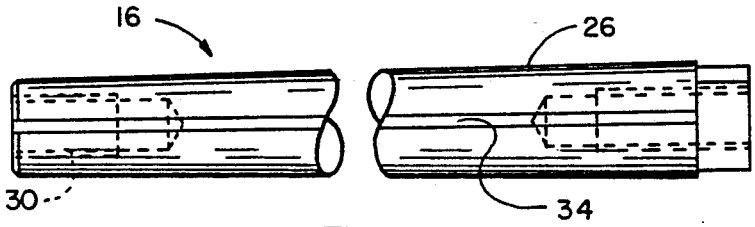
FIG. 2 is a side elevational view of the expander member or wedge assembly which is cooperatively receivable within the tubular honing member of FIG. 1.
Figure 4A:
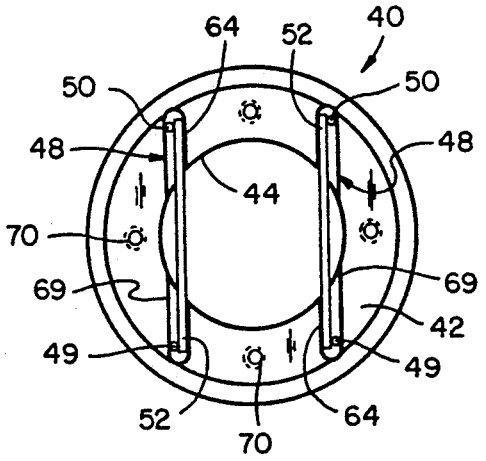
FIG. 4A and 4B are front elevational views respectively of a hub and plate member which are assembled for attachment adjacent one end portion of the tubular honing member of FIG. 1, FIG. 4A showing the resilient members engageable with the hub member.
Figure 4B:
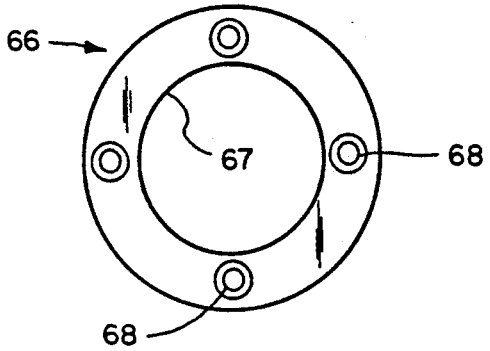
Figure 5B:
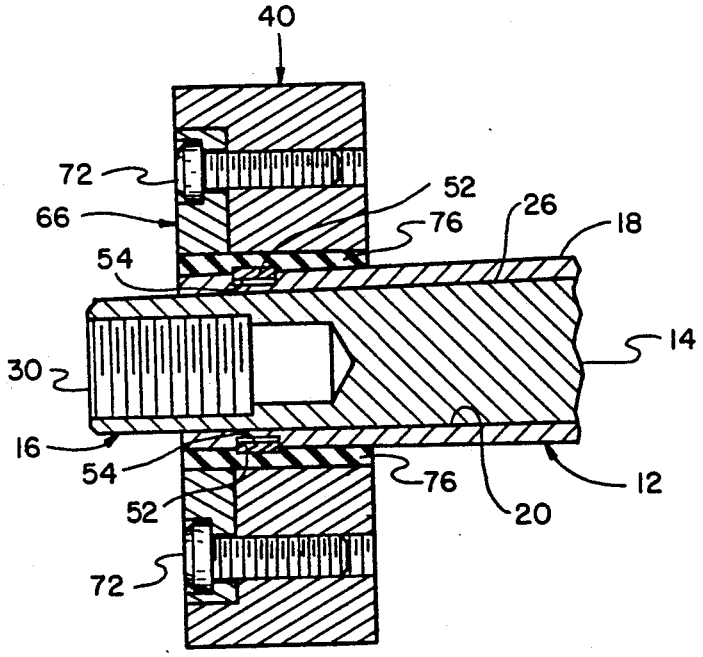
FIG. 5B is a partial cross-sectional view taken along line 5B—5B of FIG. 5A.
Figure 5A:
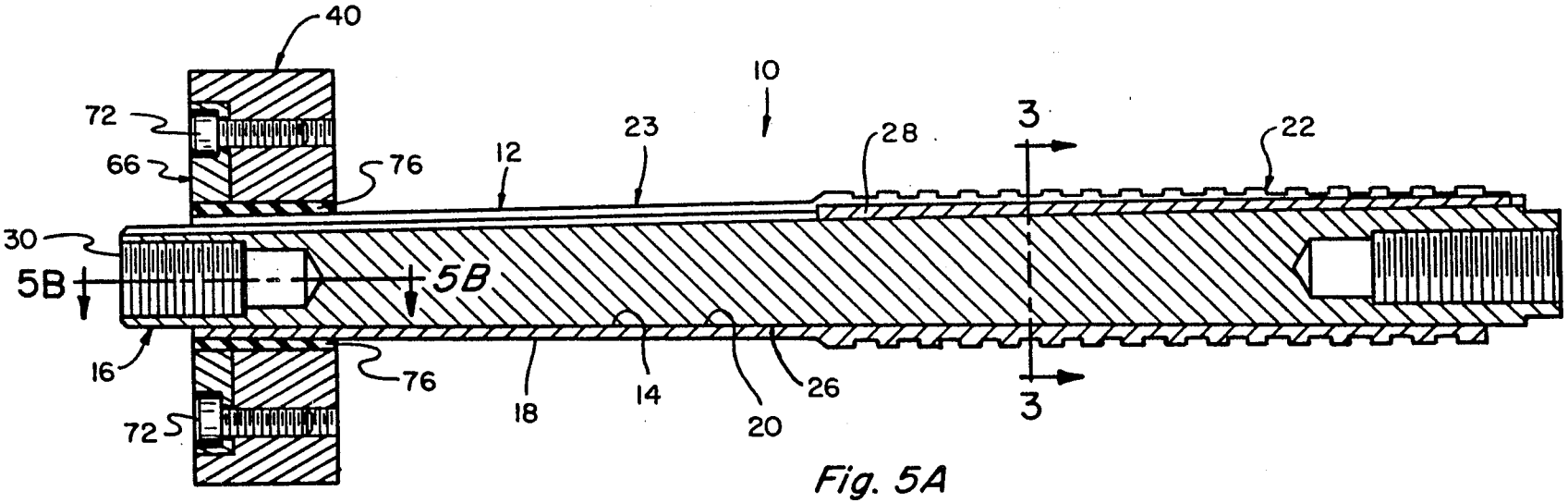
FIG. 5A is an axial cross-sectional view taken through the center of the tubular honing member, the wedge assembly, and the hub and plate members of FIGS. 1, 2, 4A and 4B when assembled in operative condition.

Referring to the drawings more particularly by reference numbers wherein like numerals refer to like parts, number 10 in FIG. 5A identifies a honing tool or mandrel constructed according to the teachings of the present invention. The honing tool or mandrel 10 includes an elongated substantially tubular honing member 12 as shown in FIG. 1, an elongated expander member or wedge member 16 as shown in FIG. 2, and hub and plate members 40 and 66 respectively as shown in FIGS. 4A and 4B. The tubular member 12 has a passageway or bore 14 extending therethrough from end to end adaptable to cooperatively receive the expander member 16. The member 12 also includes an outer surface 18, preferably substantially cylindrical, and a tapered inner bore surface 20, the inner surface 20 being axially conically tapered over substantially the entire length thereof as best shown in FIGS. 1 and 5A. The taper associated with the inner surface 20 is shown somewhat exaggerated in FIGS. 1 and 5A for clarity, while in the actual device, the taper is relatively slight. The outer surface 18 of the member 12 is coated or plated over a portion thereof with an abrasive material 22 such as a material which includes diamond particles or particles of cubic boron nitride in a suitable binder or other like hard substances. Use of such abrasive materials is well known in the honing art. Although the abrasive particles 22 illustrated in FIG. 1 are shown as being arranged in a spaced apart fluted configuration, it is recognized that a wide variety of different abrasive patterns may be utilized depending upon the particular application desired and the type of abrasive material being used. The tubular honing member 12 also includes a full length slot or groove 24 extending along one side thereof to permit expansion and contraction thereof when the expander member or wedge member 16 is axially advanced and retracted through the passageway or bore 14. The member 12 is constructed to preferably have relatively uniform expansion and contraction strength along the full length thereof. The member 12 may also include an optional helical, straight or other shaped surface groove means (not shown) that extends around the outer surface of the honing portion of the member 12, such groove means providing means along the member 12 for the circulation of honing oil or coolant during a honing operation.

The elongated expander member or wedge member 16 (FIG. 2) is slideably receivable within the tapered passageway 14 and includes an outer surface 26 which is similarly axially conically tapered over substantially its entire length at the same taper rate as the taper associated with the inner surface 20 of the member 12. This means that when the expander member 16 is slideably positioned within the passageway 14, the outer surface 26 thereof is in surface-to-surface contact with the inner surface 20 of the tubular member 12. This surface-to-surface mating of the surfaces 20 and 26 is important to the present invention because it is this arrangement which enables the outer diameter of the member 12 to be expanded uniformly over its entire length as the expander member 16 is axially moved therethrough. This means that the full length of the outer surface 18 of the member 12, that is, the abrasive portion 22 as well as the non-abrasive or holder portion 23 formed integral therewith, expands and contracts uniformly along its entire length. This results in more uniform and more accurately honed work surfaces since the total length of the member 12 expands by the same amount so that the honing pressure remains substantially constant along the length of the honing portion which is the portion that has the abrasive particles 22 thereon. This is important to maintaining the honing accuracy of the tool since uniform expansion along the mandrel assures that the abrasive particles 22 are maintained in operative engagement with the work surface along the entire length thereof during honing.

During a honing operation, both the tubular honing member 12 and the expander member 16 positioned therewithin rotate about an axis of rotation, such rotation being imparted to such members by drive means in the honing machine to which they are attached. Attachment of the subject tool 10 to a honing machine may be accomplished through use of the special constructed hub assembly 40 (FIGS. 5A, 5B and 6) as will be hereinafter explained. This is usually achieved by mounting the hub member 40 in a suitable device such as a spindle nose or other adapter associated with a particular honing device. Drive means for accomplishing rotation of the spindle nose and the tool, or mandrel 10 are well known in the honing art and may include an in-line drive mechanism such as disclosed in Vanderwal, Jr. et al U S. Pat. No. 4,512,115, or this may be accomplished by means of a belt drive arrangement, many forms of which are well known. Axial movement of the expander member 16 in the mandrel 10 can also be accomplished by known means such as by spring loaded pusher rods, rack and pinion means, cam means and the like. Such means on the honing machine can be attached to or engaged with the expander member in various ways including by means engageable with the threaded bore 30.

Figure 3A:
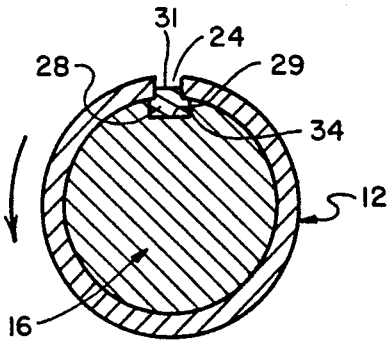
FIGS. 3A-3D are cross-sectional views taken at a location such as at line 3—3 in FIG. 5A showing various alternative means for preventing relative rotational movement between the honing member and the expander member.

The members 12 and 16 rotate together as a unit during a honing operation while at the same time the member 16 also moves axially within the member 12. To accomplish this, relative rotational movement between the members 12 and 16 must be prevented. This is accomplished through the use of any of the various keying means disclosed in FIGS. 3A–3D. In FIG. 3A, an elongated T-shaped key member 28 is shown having a stem portion 31 cooperating with the slot or groove 24 in the tubular honing member 12 and its cross portions 29 cooperating with keyway 34 formed in the member 16. The keyway 34 extends axially along one side of the expander member 16 over a substantial portion of the length thereof as shown in FIG. 2 and is adapted to cooperatively receive the cross portion 29 of key 28 as best shown in FIG. 3A. The stem portion 31 of the key 28 is dimensioned to cooperate with the slot or groove 24 in the tubular member 12. The stem portion 31 should preferably not be so wide as to tightly engage the sides of the groove 24. When the expander member 16 is positioned within the tubular honing member 12 such that the keyway 34 is located in registration with the elongated slot 24 and the key member 28 is installed as shown in FIG. 3A, little or no relative rotational movement can take place between the members 12 and 16. However, when the key 28 is installed as shown in FIG. 3A, there can be relative axial movement between the members 12 and 16 to enable the expander member 16 to be moved to change the honing diameter of the member 12. In going through expansion of the honing diameter, the slot 24 will open up somewhat but this is not generally a disadvantage. This key and slot arrangement, as shown and described, may cause some of the working load on the mandrel to be carried by the key 28 but most of the rotational load will be borne by the friction between the mating tapered surfaces 20 and 26. The elongated slot 24 therefore serves to permit expansion and contraction of the member 12 while at the same time it limits and preferably prevents relative rotational movement between the members 12 and 16. The length and strength of the key 28 can vary as desired depending upon the capacity of the load generated.

Figure 3B:
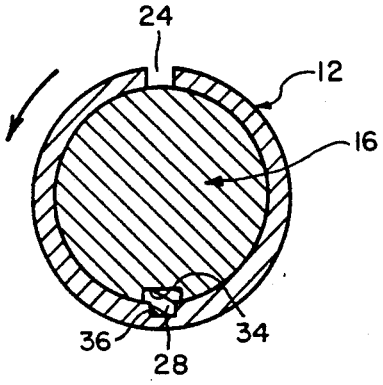
Figure 3C:
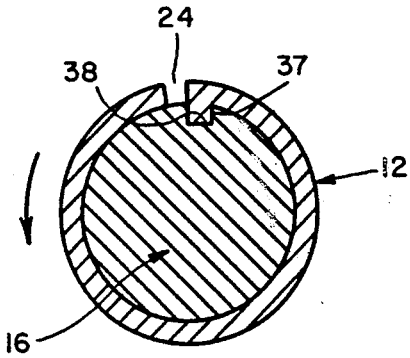
Figure 3D:
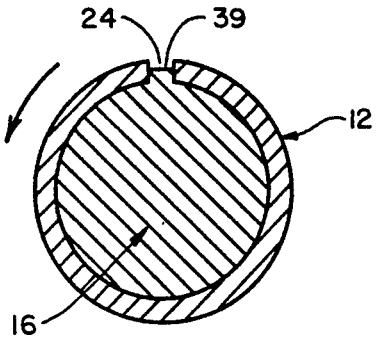

It is also anticipated that other means for preventing relative rotational movement between the tubular member 12 and the expander member 16 can be utilized. For example, as shown in FIG. 3B, the tubular member 12 may include an axially extending groove or channel 36 circumferentially spaced from the axial slot 24, the key member 28 being cooperatively engageable with the keyway 34 and the channel 36 in the same manner as previously explained with respect to the means shown in FIG. 3A. Additionally, the tubular member 12 may include a downwardly projecting flange portion 37 integrally formed therewith, the projecting flange 37 being cooperatively receivable within a correspondingly shaped groove or channel 38 extending axially along one side of the expander member 16 as shown in FIG. 3C. Still further, the expander member or wedge 16 may include an elongated projection member 39 extending axially along one side thereof and being integrally formed therewith, the projection member 39 being cooperatively engageable with the elongated slot 24 on the member 12 as shown in FIG. 3D. All of the arrangements shown in FIGS. 3A–3D can be used to prevent relative rotational movement between the tubular member 12 and the expander member 16 while, at the same time, allowing relative axial movement between such members to enable adjustment of the honing diameter as previously explained.

Referring to FIG. 3B, it has been discovered that if the key 28 is located slightly behind the leading edge of rotation of the mandrel, such positioning helps to dampen any chatter and vibration which may sometimes occur when the abrasive surface is new and sharp during the break-in process. The keying means shown in FIG. 3C for preventing rotational movement between the members 12 and 16 also serves to stiffen the axial deflection of the tubular member 12 to compensate for the slot 24 associated therewith. This additional stiffness has also been shown to assist in the prevention of harmonic vibration or chatter that occurs in less stiff tools when the abrasive surface is new and sharp during the break-in process.

Figure 6:
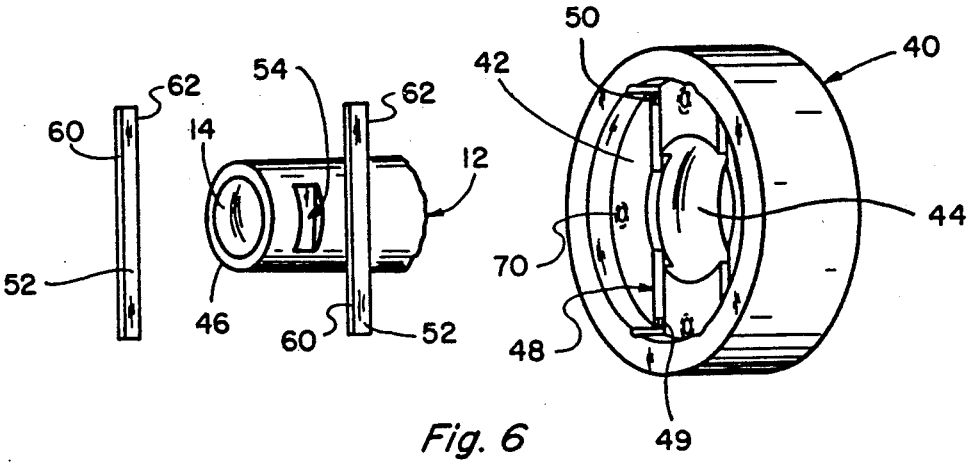
FIG. 6 is an exploded perspective view illustrating how engagement is made between one end portion of the tubular honing member and the hub member of FIG. 4A.

The hub assembly 40 (FIGS. 4A, 5A, 5B and 6) is shown substantially cylindrical in shape and includes a recessed portion 42 as best shown in FIG. 6 having a central opening 44 extending therethrough dimensioned to cooperatively receive the end portion 46 of the tubular member 12. The recessed hub portion 42 includes a pair of elongated parallel slots 48 positioned and located adjacent opposite portions of the opening 44 as shown in FIGS. 4A and 6, each of the slots 48 including a pair of pin members 49 and 50 positioned and located respectively adjacent each opposite end thereof as best shown in FIG. 4A. A resilient member 52 is positioned in each of the slots 48 and, when the device is assembled, cooperates with cutouts 54 located on opposite sides of the tubular member 12 adjacent end portion 46 thereof as will be hereinafter more fully explained. Cooperation between the resilient members 52 and the sides or flange portions 56 and 58 of the cutouts 54 enables the hub assembly 40 to impart axial driving or resisting force to the tubular member 12 as the expander member 16 is moved axially to expand or retract the member 12. The connection between the hub assembly 40 and the member 12 also enables the member 12 to expand and contract uniformly along its full length as the expander member 16 is moved axially therethrough. If the member 12 were fixedly attached to the assembly 40 this could not be so and the expander would not be able to move axially to expand and contract the tubular member uniformly. This would produce inaccuracies in the honing operation because it would cause some non cylindricality in the outer work engaging portion of the mandrel.

The cutouts 54 associated with the end portion 46 of the member 12 are shown positioned in diametrically opposed relationship in FIG. 1. Each cutout 54 is shown including a pair of spaced outwardly extending flanges 56 and 58 adapted to cooperatively receive and engage respective side edges 60 and 62 (FIG. 6) of the resilient members 52 when the members 52 are positioned in the respective slots 48. The resilient members 52 are preferably constructed of spring steel and when installed on edge in the respective slots 48 are located extending between the respective pin members 49 and 50 and the innermost slot sidewall 64 as clearly shown in FIG. 4A. In this position, the central portions of the members 52 also extend through the cutouts 54 and when so positioned and properly assembled as will be described the members 52 will bear against one or the other of the opposite walls 56 and 58 of the cutouts 54 to resist stroking forces to the assembly 10 in opposite directions.

Once the resilient members 52 are positioned extending across their respective cutouts 54, a plate or closure member 66 is positioned in the recessed hub area 42 as shown in FIGS. 5A and 5B and secured therein by threaded members 72. The closure member 66 maintains the resilient members 52 in position. The member 66 also includes a central opening 67 which is aligned with the opening 44 through the hub member 40. In addition, the member 66 has a plurality of apertures 68 which register with a plurality of threaded apertures 70 located in the hub member 40. The threaded fastener members 72 shown in FIGS. 5A and 5B are used to attach the plate 66 to the hub 40. Threaded means are shown for illustrative purposes only and can be replaced by other means known in the art. Before assembling the hub 40 on the end portion 46 of the tubular honing member 12, it is positioned with the resilient members 52 extending through the cutouts 54 while they are in their respective slots 48. When so assembled and secured there will be a space formed by and between the tubular member 12 and the hub 40 including some space in the hub 40 around the resilient members 52, and this space will be filled with a material such as an elastomer 76 which is relatively resilient and will allow some relative movement between the members 12 and 40 to enable the diameter of the members 12 to expand and contract in the hub. Therefore, when mandrel stroking means are used to impart a stroking force to the hub member 40, the resilient members 52 will bear against a side of the respective cutouts 54 to resist stroking forces to the tubular honing member 12.

As previously mentioned, the arrangement of the resilient members 52 within the hub slots 48 allows the end portion 46 of the member 12 to expand and contract radially to some extent as the expander member or wedge assembly 16 is moved axially therein. This is because the width of the respective slots 48 provides sufficient space to enable the resilient members 52 to bend or flex about the respective pin members 49 and 50 towards the outermost slot sidewall 69 thereby enabling the end portion 46 of the member 12 thereat to expand and contract along with the rest of the member 12 when the expander member is moved therein. Some looseness or space may also be provided between the bottom of the cutouts 54 and the resilient members 52 so that little or no flexing of the members 52 may be required. The feature just described is especially important because it means the mandrel can expand uniformly along its length and also means that the mandrel can be adjusted during honing albeit over a relatively narrow range in the order of up to about .050 inches. Even this narrow range, however, is extremely important because it means that much more honing can be accomplished with super abrasives than has been possible with known devices such as with known single pass mandrels. By providing sufficient expansion space between the resilient members 52, the cutouts 54, and the hub slots 48 any tendency for the tubular member 12 to bend or twist is also largely overcome or neutralized. Being allowed to expand and contract uniformly along with the full length of the mandrel therefore plays an important roll in the accuracies of the honing that can be accomplished.

Since the central openings 44 and 67 through the hub member 40 and the plate member 66 respectively are slightly larger than the outer diameter of the tubular end portion 46 at that point to permit uniform radial expansion and contraction of the member 12 as previously explained, the annular space formed therebetween as well as other cavities and spaces in the hub are filled with an elastomer material 76 or like resilient material which does not lose its flexibility. This provides some stability and rigidity to the tubular member 12 and helps to hold the members together while at the same time allowing the end portion 46 to expand and contract in response to axial movements of the expander member 16.

Figure 7:
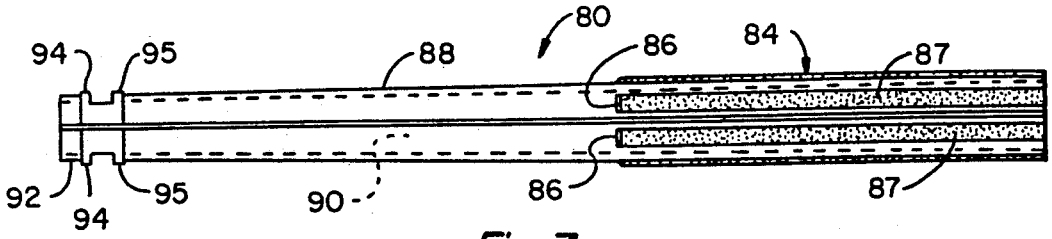
FIGS. 7 and 8 are side elevational views respectively of another embodiment of a tubular honing member and wedge assembly constructed according to the teachings of the present invention.
Figure 8:
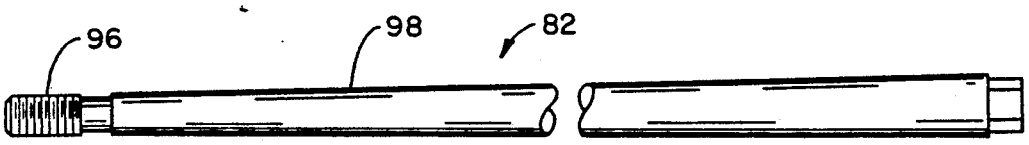
Figure 9:
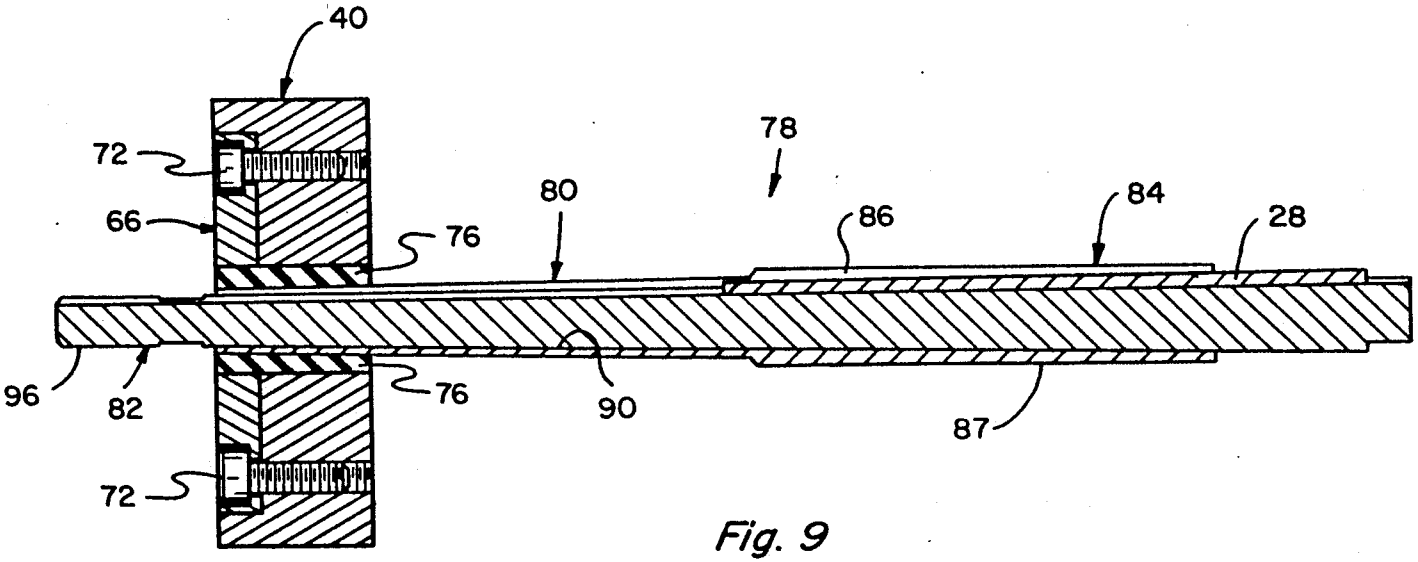
FIG. 9 is a cross-sectional view taken through the center of the tubular honing member and wedge assembly of FIGS. 7 and 8 showing a modified hub and plate member similar to FIGS. 4A and 4B mounted thereon.

FIGS. 7-9 disclose another embodiment 78 of a honing tool constructed according to the teachings of the present invention. The tool 78 (FIG. 9) includes a tubular honing member 80 (FIG. 7) and an expander or wedge member 82 (FIG. 8). The tubular member 80 is similar in construction to the member 12 (FIG. 1) differing therefrom only in the arrangement of the abrasive portion 84 on the honing portion of such member. As can be seen from FIG. 7, the abrasive portion 84 extends over less than half the length of the member and includes a plurality of elongated outwardly extending lands 86 circumferentially spaced about the portion 84 and coated or plated with abrasive particles 87. In other respects, the tubular member 80 is like the tubular member 12 including having a reduced diameter portion 88. The member 80 also has an axially tapered inner surface 90. The end portion 92 of the member 80 includes spaced flanges 94 and 95 which form an annular groove for cooperation with a hub or mounting structure which may be similar to the hub 40.

The expander member 82 shown in FIG. 8 is likewise similar to the expander member 16 shown in FIG. 2 differing therefrom only in that the member 82 includes an externally threaded end portion 96 for attaching to means for moving the wedge 82 axially in the honing machine on which the device is installed to produce relative axial movement between the expander member 82 and the tubular member 80. Like the expander member 16, the member 82 is slidably receivable within the tapered passageway 90 in the member 80 and includes an outer axially tapered surface 98 which is similarly tapered over substantially its entire length to mate in surface-to-surface contact with the inner tapered surface 90 of the member 80. As shown in FIG. 9, the tubular honing member 80 is attachable to a hub assembly such as hub assembly member 40 in the same manner as previously discussed with respect to the member 12. Also, any one of the key and slot arrangements illustrated in FIGS. 3A-3D can be utilized to prevent relative rotational movement between the members 80 and 82.

Figure 10:
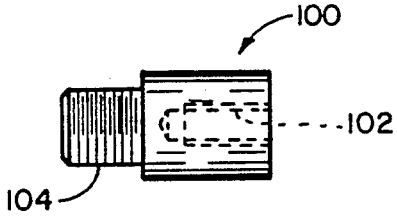
FIG. 10 is a side elevational view of an adapter member engageable with the threaded end portion of the wedge assembly of FIG. 8 used for attaching it to means on a honing machine.

FIG. 10 illustrates an adapter member 100 which may be attached to the threaded end portion 96 of the expander member 82 for attaching the wedge 82 to feed up means in a honing machine. The adapter member 100 is shown including a threaded bore 102 associated with one end portion for cooperatively engaging the threaded means 96 and external threaded means 104 on the opposite end for engagement with means on the honing machine to which it is attached.

Figure 11:
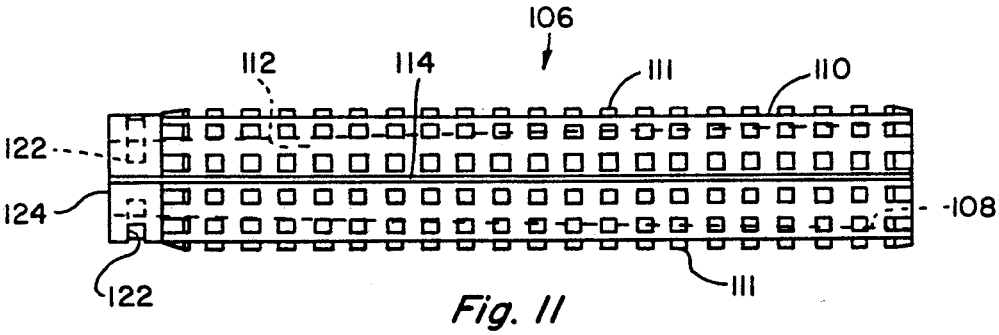
FIG. 11 is a side elevational view of still another embodiment of a tubular honing member constructed according to the teachings of the present invention.
Figure 12:
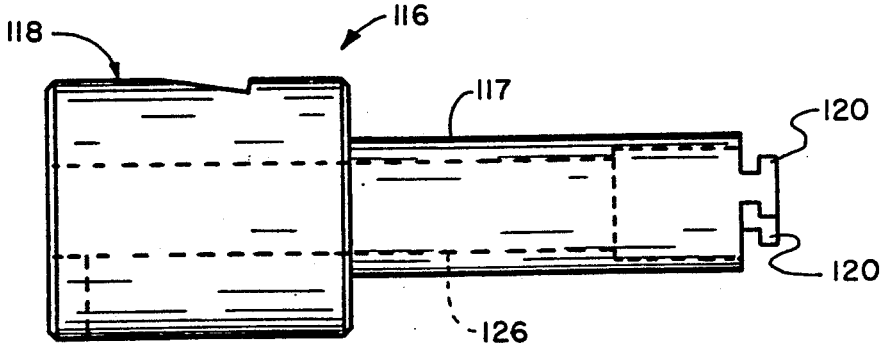
FIG. 12 is a side elevational view of a drive assembly engageable with one end portion of the tubular honing member of FIG. 11 for drivingly connecting the same to a honing machine.

FIGS. 11 and 12 show still another embodiment of a tubular honing mandrel which is a two-piece construction including a tubular work engaging abrasive honing portion 106 (FIG. 11) and a drive assembly 116 (FIG. 12). The portion 106 has a full length bore or opening 108 that extends therethrough from end to end and includes an outer surface 110 formed by spaced projections 111 each of which has an exposed outer work engaging surface coated or plated with an abrasive such as a super abrasive. All of the work engaging surfaces are arranged to be in a cylindrical envelope so that the honing or working diameter of the member is uniform from end to end. The member 106 also has an axially tapered inner surface 112. The outer surface 110 including the projections 111 are coated or plated with an abrasive material as stated.

The drive assembly 116 includes a tubular shaft portion 117 and adapter means 118 associated with one end for mounting it for rotation on a honing machine and the opposite end portion of the member 116 includes a pair of T-shaped endwardly extending flanges 120 which are in opposed relation and are sized and shaped to cooperatively engage a corresponding pair of opposed T-shaped slots 122 formed in the end portion 124 of the member 106. The T-shaped slots 122 are shown for illustrative purposes only as other shapes can be used. The flanges 120 are movable transversely into the respective slots 122 in which case the members 106 and 117 are in axial alignment.

The tubular shaft portions 117 may have an axial tapered bore 126 extending therethrough from end to end which bore communicates with the opening 112 in the honing member 106 when the members 106 and 116 are assembled. When so engaged, an expander member similar in construction and operation to the members 16 and 82 is positioned extending through the aligned bores 126 and 108 to hold the members together and, when moved axially, it expands or enables the member 106 to contract to change its honing diameter. The member 117 may be slitted axially to enable it also to change diameter, in which case the member 117 will have to be mounted in a hub portion such as shown in FIGS. 5A and 5B, or the bore 126 can be made oversized as shown in FIG. 12 so that no expansion or contraction takes place. In this construction, as in those discussed above, the entire length of the tubular honing member 106 expands and contracts uniformly over the length thereof which is a major advantage and it means that the honing diameter can be changed during a honing operation which is not possible with single pass through tubular mandrels as noted above. This also means that all work engaging portions of the mandrel can be on a common cylindrical envelope as aforesaid. However, in the embodiment shown in FIGS. 11 and 12, only the member 106 need change diameter as the expander member is moved axially. Also, the expander member may be keyed to one or both of the members 106 and 116 and any one of the keying means illustrated in FIGS. 3A–3D, as well as others, can be utilized to prevent relative rotational movement between the expander member and the honing member 106.

The present tool or mandrel constructions lend themselves particularly for use on a computer controlled honing machine such as the computer controlled honing machine disclosed in Davis et al U.S. Pat. application Ser. No. 100,726, filed Sept. 25, 1987, wherein the initial and final or finished bore sizes are important.

Thus, there has been shown and described several embodiments of a novel honing tool or mandrel construction, which fulfills all of the objects and advantages sought therefor. Many changes, modifications, variations and other uses and applications of the present device will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A honing mandrel adjustable during a honing operation and rotatable about an axis of rotation comprising an elongated substantially tubular member having inner and outer surfaces, said inner surface being conically tapered over substantially the length thereof, said outer surface including a portion having abrasive particles attached thereto, means adjacent one end of said tubular member for attaching to a rotatable member for rotation therewith, means through one side of said tubular member extending the full length thereof to permit expansion or contraction of the diameter of said tubular member substantially uniformly along the length thereof during a honing operation, an elongated expander member positioned extending through said tubular member and having an outer surface conically tapered over substantially the length thereof, the outer surface of said expander member being tapered at the same taper rate as the conical taper of the inner surface of said tubular member such that the inner surface of said tubular member is in surface-to-surface contact with the outer surface of said expander member, means to prevent relative rotational movement between said tubular member and said expander member, and other means on the mandrel for attaching to means to produce relative axial movement between said tubular member and said expander member during rotation thereof to change the diameter of said tubular member during a honing operation.

2. The honing mandrel defined in claim 1 wherein said means through one side of said tubular member is an opening that extends substantially the length thereof.

3. The honing mandrel defined in claim 1 wherein said means to prevent relative rotational movement between said tubular member and said expander member include an axial slot in said tubular member, an axial keyway in said expander member, and a key member cooperatively engageable with said axial slot and said keyway when said slot and keyway are in registration.

4. The honing mandrel defined in claim 1 wherein said means to prevent relative rotational movement between said tubular member and said expander member include an inwardly extending projection on said tubular member, and a correspondingly shaped groove extending axially along the side of said expander member, said projection being cooperatively engageable with said groove when said expander member is slidably positioned within said tubular member.

5. The honing mandrel defined in claim 1 wherein said means to prevent relative rotational movement between said tubular member and said expander member include an axially extending slot in said tubular member, and a projection extending outwardly along one side of said expander member, said projection being cooperatively engageable with said slot when said expander member is slidably positioned within said tubular member.

6. The honing mandrel defined in claim 1 wherein said means adjacent one end of said tubular member for attaching to a rotatable member includes a pair of spaced opposed transverse grooves respectively on opposite sides thereof.

7. The honing mandrel defined in claim 6 wherein said means adjacent one end of said tubular member for attaching to a rotatable member includes a pair of transversely extending resilient members cooperatively engageable respectively with the transverse grooves in said tubular member.

8. The honing mandrel defined in claim 7 wherein said means adjacent one end of said tubular member for attaching to a rotatable member includes a hub assembly for supporting the resilient members.

9. The honing mandrel defined in claim 8 wherein said hub assembly is filled with a resilient material.

10. The honing mandrel defined in claim 1 wherein said means adjacent one end of said tubular member for attaching to a rotatable member includes means for allowing said one end of said tubular member to radially expand and contract.

11. The honing mandrel defined in claim 1 wherein said means adjacent one end of said tubular member for attaching to a rotatable member includes means for imparting axial force to said tubular member.

12. The honing mandrel defined in claim 10 wherein said means for allowing one end of said tubular member to expand or contract when attached to said rotatable member includes a pair of resilient members, a pair of spaced and opposed grooves located on opposite dies of said tubular member, said resilient members having means associated therewith that extend through said respective grooves, and a hub assembly including means for supporting said resilient members, said grooves being formed to enable limited radial movement of said resilient members therein.

13. The honing mandrel defined in claim 1 wherein at least a portion of the outer surface of said tubular member is coated with abrasive particles defining work engaging portions, all of said work engaging portions being on a substantially cylindrical honing envelope.

14. In a honing machine having a mandrel rotatable about an axis of rotation, means for mounting the mandrel for rotation on the honing machine, and means on the honing machine for changing the honing diameter of the mandrel during a honing operation, the improvement comprising a mandrel which includes an elongated tubular member having an outer surface with abrasive particles over a portion of the length thereof and an inner surface tapered axially substantially from end-to-end, an elongated slot through said tubular member extending from end-to-end the full length thereof to enable said tubular member to expand or contract relatively uniformly along the length thereof during a honing operation, means adjacent one end of said tubular member for mounting said tubular member on the honing machine for rotation, said mounting means including means to enable said tubular member to change its diameter thereat and therefor substantially uniformly along the entire length thereof, an expander member positioned in said tubular member and having an outer axially tapered surface for making surface-to-surface contact with the tapered inner surface of said tubular member along the length thereof, cooperatively engageable means on the tubular member and on the expander member to prevent relative rotational movement therebetween, and means on said expander member for connection to the means on the honing machine for enabling changing of the axial position thereof in the tubular member during a honing operation to change the diameter of said tubular member along the length thereof.

15. The improvement defined in claim 14 wherein said means adjacent one end of said tubular member include means forming at least one transversely extending groove therein and means mounted on the honing machine engageable with said groove to maintain the mounting means engaged with the mandrel for movement axially in concert with each other.

16. The improvement defined in claim 14 wherein said means to enable the tubular member to change its diameter along the length thereof includes a mounting assembly having a pair of spaced resilient members therein and transverse groove means on said tubular member for cooperatively engaging said resilient members to enable the transfer of axial force between the mounting assembly and the tubular member, said mounting assembly permitting some relative radial movement between the resilient members and said groove means to accommodate radial changes in the tubular member thereat.

17. A honing tool adjustable during a honing operation and mounted for rotation on a honing machine comprising an elongated tubular member having inner and outer surfaces, said inner surface being axially tapered over substantially the length thereof, said outer surface having a portion of its axial length defined by work engaging abrasive portions arranged about the periphery thereof, said work engaging portions all lying on a substantially cylindrical honing envelope, an axial slot through said tubular member extending the full length thereof to permit relatively uniform expansion or contraction of the diameter of said tubular member along the full length thereof during a honing operation, an elongated expander member positioned extending through said tubular member and having an outer surface axially tapered such that the inner surface of said tubular member is in surface-to-surface contact with the outer surface of said expander member along the length thereof, means adjacent one end of said tubular member for mounting said tubular member for rotation on a honing machine, said mounting means including means cooperatively engageable with said tubular member to enable radial expansion or contraction thereat, cooperatively engageable means on the tubular member and on the expander member to prevent relative rotational movement therebetween, and means on said expander member for engagement with means on a honing machine to produce relative axial movement between said tubular member and said expander member during rotation thereof to change the diameter of the outer surface of said tubular member during a honing operation.

18. A honing mandrel adjustable during a honing operation and rotatable about an axis of rotation comprising elongated first and second substantially tubular members each having an inner and outer surface and a passageway extending therethrough from end-to-end, said tubular members having adjacent ends with cooperatively engageable interlocking means thereon which permit said members to be fastened together in alignment, the inner surface of at least one of said tubular members being tapered over substantially the length thereof, at least a portion of the outer surface of said one tubular member having abrasive particles thereon and having means along one side thereof extending the full length thereof to enable said member to expand or contract uniformly along the entire length thereof during a honing operation, the other of said tubular members having means adjacent one end thereof for mounting it for rotation on a honing machine, an elongated expander member positioned extending through the aligned passageways in said first and second tubular members and having an outer axially tapered surface for making surface-to-surface engagement with the tapered inner surface of said one tubular member, other cooperatively engageable means on at least one of said first and second tubular members and said expander member to prevent relative rotational movement therebetween and means on the honing machine engageable with the expander member to produce relative axial movement between said tubular members and said expander member during rotation thereof to change the diameter of at least said one tubular member during a honing operation.

19. The honing mandrel defined in claim 18 wherein said means along one side of said one tubular member includes a slot extending the length thereof.

20. The honing mandrel defined in claim 18 wherein said means for cooperatively engaging said first and second tubular members include interlocking flanges and grooves, said flanges being located on one member and the grooves for receiving said flanges being located on the other member.

21. The honing mandrel defined in claim 18 wherein said means for cooperatively engaging said first and second tubular members includes means for allowing at least one of said tubular members to expand and contract uniformly along the length thereof.

22. The honing mandrel defined in claim 20 wherein said expander member maintains the cooperatively engageable means on said first and second tubular members engaged and the tubular members in alignment.

23. A honing mandrel rotatable about an axis of rotation comprising an elongated substantially tubular member having inner and outer surfaces, said inner surface being conically tapered over substantially the length thereof, said outer surface including a portion having abrasive particles attached thereto, means adjacent one end of said tubular member for attaching to a rotatable member for rotation therewith, said attaching means including a pair of spaced opposed transverse grooves respectively on opposite sides of said tubular member, means through one side of said tubular member extending substantially the length thereof to permit expansion or contraction substantially uniformly along the length of said tubular member, an elongated expander member positioned extending through said tubular member and having an outer surface conically tapered over substantially the length thereof, the outer surface of said expander member being tapered at the same taper rate as the conical taper of the inner surface of said tubular member such that the inner surface of said tubular member is in surface-to-surface contact with the outer surface of said expander member, means to prevent relative rotational movement between said tubular member and said expander member, and other means on the mandrel for attaching to means to produce relative axial movement between said tubular member and said expander member during rotation thereof to change the diameter of said tubular member.

* * * * *

UNITED STATES PATENT AND TRADEMARK OFFICE

CERTIFICATE OF CORRECTION

PATENT NO. : 5,022,196

DATED : June 11, 1991

INVENTOR(S) : John J. Schimweg, et al

It is certified that error appears in the above—identified patent and that said Letters Patent is hereby corrected as shown below:

Column 13, line 31, "dies" should be --sides--.

Signed and Sealed this

Twenty-second Day of December, 1992

*Attest:*

DOUGLAS B. COMER

*Attesting Officer*

*Acting Commissioner of Patents and Trademarks*